US007418792B2

(12) United States Patent
Pai

(10) Patent No.: US 7,418,792 B2
(45) Date of Patent: Sep. 2, 2008

(54) COMPOSITE SHOE SOLE

(75) Inventor: Chun-Shun Pai, XiZhi (TW)

(73) Assignee: Lar New International Corporation, Taipei (TW)

( * ) Notice: Subject to any disclaimer, the term of this patent is extended or adjusted under 35 U.S.C. 154(b) by 387 days.

(21) Appl. No.: 11/179,651

(22) Filed: Jul. 13, 2005

(65) Prior Publication Data

US 2006/0080863 A1 Apr. 20, 2006

(30) Foreign Application Priority Data

Oct. 14, 2004 (TW) ..... 93216334 U

(51) Int. Cl.
*A43B 13/12* (2006.01)
*A43B 13/14* (2006.01)
*A43B 13/38* (2006.01)

(52) U.S. Cl. ..... 36/30 R; 36/31; 36/44

(58) Field of Classification Search ..... 36/30 R, 36/31 X, 143, 144, 44
See application file for complete search history.

(56) References Cited

U.S. PATENT DOCUMENTS 5,542,196 A * 8/1996 Kantro ..... 36/44
6,408,543 B1 * 6/2002 Erickson et al. ..... 36/100
6,665,956 B2 * 12/2003 Hay ..... 36/25 R

* cited by examiner

*Primary Examiner*—Ted Kavanaugh
(74) *Attorney, Agent, or Firm*—Lowe Hauptman Ham & Berner, LLP

(57) ABSTRACT

A composite shoe sole, composed of an upper layer and a lower layer, wherein the upper layer is integrally formed of a soft material and the lower layer is integrally formed of a hard material, the lower layer being formed with a notch at a location corresponding to a right side of thenar, or right-side region of phalanx, the upper layer being formed with a projection at a location corresponding to the notch, such that the upper layer and lower layer are joined to each other by means of engagement between the projection and notch to form a shoe sole having a soft upper layer with elastic and shock-absorbing effects for relieving foot pressure, and a hard lower layer for providing upward support to the soft upper layer so as to prevent cave-in, thereby providing good bottom support, elastic air cushioning and shock-absorbing effects.

1 Claim, 2 Drawing Sheets

COMPOSITE SHOE SOLE

CROSS-REFERENCES TO RELATED APPLICATIONS

The Invention claims the priority date of Taiwan Patent Application No. 093216334 filed on Oct. 14, 2004 and having the same title.

STATEMENT REGARDING FEDERALLY SPONSORED RESEARCH OR DEVELOPMENT

Not Applicable

FIELD OF INVENTION

This invention relates to an improved shoe sole structure, particularly to one with a soft upper layer and a hard lower layer that provide good bottom support, elastic air cushioning and shock-absorbing effects.

BACKGROUND

According to American Podiatric Medical Association, the pressure that a person feet sustain is approximately equal to one's weight while walking and as well as 3 to 3 times of one's weight while running. Taking a person weighing 60 Kg as an example, the overall pressure that one's feet sustain in a one day is as high as 600-1200 tons. It is thus likely to cause weariness and pains to the feet if the reactive pressure applied by the ground is only counteracted by a thin layer of foaming material, thereby damaging one's knees, waist or even spine after an extensive period of time.

To effectively relieve the pressure applied to one's feet, various shoe soles claiming to be equipped with air cushioning effect have been developed. Where the so-called elastic and shock-absorbing effects are able to support foot arch by means an arch chamber to mitigate pressure sustained by the feet and to improve foot comfort. For example, U.S. Pat. No. 5,218,056 discloses an elastic air cushion, where indents are formed at locations corresponding to one's metatarsus and calcaneus, in which indents sheet-like elastic air cushions are received. U.S. Pat. No. 4,918,838 further discloses an elastic air cushion structure, where a cylindrical shock-absorbing component is placed in a circular bore formed at the heel.

Though the above air cushioned shoes are capable of reducing the reactive pressure resulted from one's weight, their structure tends to be relatively complicated and result in dislocation of the shock-absorbing component after a period of time, thereby failing to provide an optimum contact between the shock-absorbing component and soles at a proper orientation, and resulting in discomfort similar to prolonged toe-tipping.

Furthermore, the Taiwan Patent Application No. 90215337 entitled "Composite Inner Sole with Hard and Soft Features" discloses a composite inner sole integrally formed of a material with different hardness by injection forming. The sole top of the inner sole is provided with a hard end portion and at least one soft end portion. The hard end portion and the soft end portion is progressively joined to each other. The soft end portion is pliable, flexible and deformable while the hard end portion is rigid, less flexible and deformable. However, the soft end portion is partially provided to the sole top so as to require high precision in manufacturing. Furthermore, the degree of wearing for the soft end portion is not comparable to the hard sole top, thereby resulting in discomfort similar to prolonged toe-tipping as the soft end portion is not located at the same level of the hard sole top after a period of time.

SUMMARY OF INVENTION

To overcome the drawbacks of the conventional air cushioning soles, this invention discloses a composite shoe sole.

It is thus an object of this invention to provide a composite shoe sole, composed of an upper layer and a lower layer, wherein the upper layer is integrally formed of a soft material and the lower layer is integrally formed of a hard material, the lower layer being formed with a notch at a location corresponding to a right side of thenar, or right-side region of phalanx, the upper layer being formed with a projection at a location corresponding to the notch, such that the upper layer and lower layer are joined to each other by means of engagement between the projection and notch to form a shoe sole having a soft upper layer with elastic and shock-absorbing effects for relieving foot pressure, and a hard lower layer for providing upward support to the soft upper layer so as to prevent cave-in, thereby providing good bottom support, elastic air cushioning and shock-absorbing effects.

BRIEF DESCRIPTION OF THE DRAWINGS

These and other modifications and advantages will become even more apparent from the following detained description of a preferred embodiment of the Invention and from the drawings in which.

DETAILED DESCRIPTION OF THE INVENTION (PREFERRED EMBODIMENTS)

Figure 1:
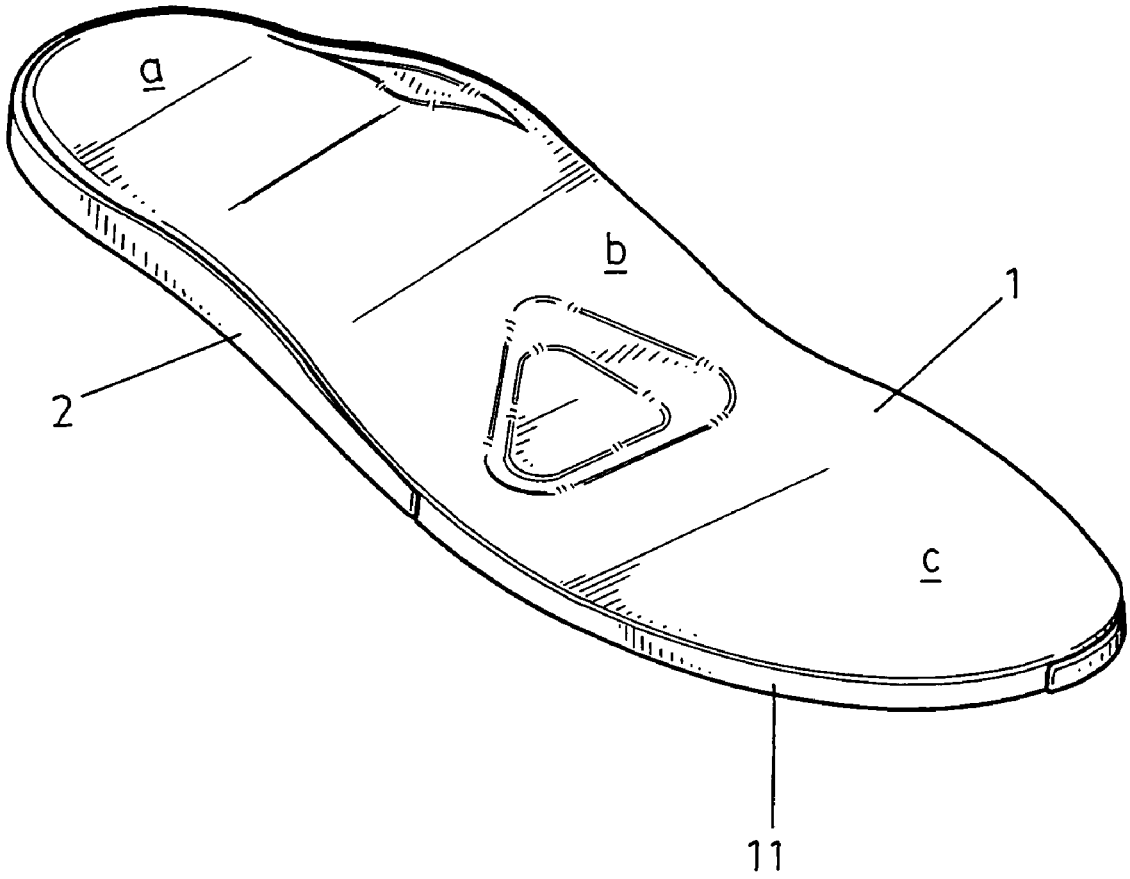
FIG. 1 is a perspective view showing the appearance of this invention shoe sole after composition.
Figure 2:
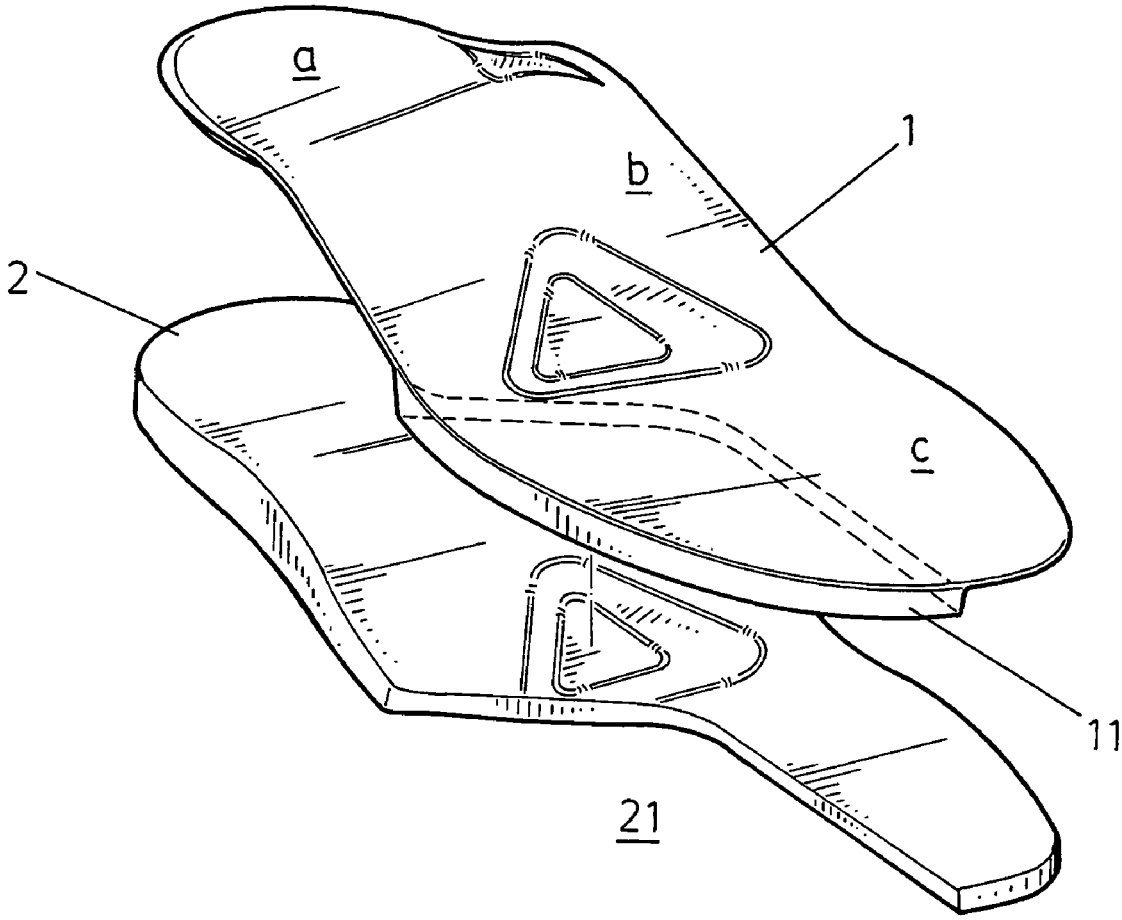
FIG. 2 is an exploded, perspective view showing a shoe sole of this invention prior to composition.

These and other modifications and advantages will become even more apparent from the following detained description of a preferred embodiment of the invention and from the drawings in which:

With reference to FIGS. 1 and 2, the shoe sole of this invention is composed of an upper layer 1 and a lower layer 2, wherein the upper layer 1 is integrally formed of a soft material and the lower layer 2 is integrally formed of a hard. The upper layer 1 and lower layer 2 are each formed with rippling regions, such as a caved heel a, a raised arch b and a planar thenar, so as to conform to ergonomic curvature. Such designs are conventional and not repeated herein.

The composite shoe sole of this invention is characterized in that, the lower layer 2 is formed with a notch 21 at a location corresponding to a right side of thenar, or right-side region of phalanx, and the upper layer 1 is formed with a downward projection 11 (as shown in FIG. 2) at a location corresponding to the notch 21, such that the upper layer 1 and lower layer 2 are joined to each other by means of engagement between the projection 11 and notch 21 (as shown in FIG. 1). The means for engagement one be adhesion applied during or after the process of integral forming.

By adopting the above shoe sole made of a soft top and a hard bottom by composition, the shoe sole provides a soft upper layer with elastic and shock-absorbing effects for relieving foot pressure, and a hard lower layer for providing upward support to the soft upper layer so as to prevent cave-in, thereby providing good bottom support, elastic air cushioning and shock-absorbing effects, so as to effectively relieve the reactive pressure applied by the ground in walking.

In view of the above, this invention provides a composite shoe sole with a simple structure yet having significant effects, with effectively provide bottom support and shock-absorbing features to mitigate the reactive pressure applied by the ground in walking.

This Invention is related to a novel creation that makes a breakthrough in the art. Aforementioned explanations, however, are directed to the description of preferred embodiments according to this invention. Since this Invention is not limited to the specific details described in connection with the preferred embodiments, changes and implementations to certain features of the preferred embodiments without altering the overall basic function of the Invention are contemplated within the scope of the appended claims.

What is claimed is:

1. A composite shoe sole with elastic and shock-absorbing effects for relieving foot pressure, said shoe sole having an upper layer formed of relatively soft material and a lower area formed of relatively hard material and each of said layers formed with rippling regions including a caved heel, a raised arch and a planar thenar to thereby provide ergonomic curvature, and said lower layer formed with a single recess in the general form of an inverted frustum of a pyramid and said upper layer formed with a single downward projection in the general form of an inverted frustum of a pyramid corresponding to the single recess and means for adhesively engaging said recess and said projection such that said upper layer and said lower layer are joined to each other and wherein said recess in said lower layer is formed at a location corresponding to a right side of thenar, or right side region of a phalanx.

* * * * *